US006560904B2

(12) United States Patent
Guggino

(10) Patent No.: US 6,560,904 B2
(45) Date of Patent: May 13, 2003

(54) COMPACT MATERIAL PUSHER WITH UNIVERSAL DESIGN AND METHOD OF MANUFACTURE

(75) Inventor: Michael J. Guggino, Bloomfield, NY (US)

(73) Assignee: Pro-Tech Welding and Fabrication, Inc., Rochester, NY (US)

( * ) Notice: Subject to any disclaimer, the term of this patent is extended or adjusted under 35 U.S.C. 154(b) by 0 days.

(21) Appl. No.: 09/882,162

(22) Filed: Jun. 15, 2001

(65) Prior Publication Data

US 2003/0061741 A1 Apr. 3, 2003

(51) Int. Cl.[7] ..... E01H 5/04
(52) U.S. Cl. ..... 37/233; 37/270
(58) Field of Search ..... 37/232, 233, 219, 37/266, 267, 270, 281, 454, 449

(56) References Cited

U.S. PATENT DOCUMENTS

| | | | |
|---|---|---|---|
| 634,578 | A | 10/1899 | Kaucher |
| 637,712 | A | 11/1899 | Damerell |
| 842,704 | A | 1/1907 | Robins |
| 2,445,140 | A | 7/1948 | Hanington |
| 2,552,426 | A | 5/1951 | Hedley |
| 2,577,977 | A | 12/1951 | Nelson |
| 2,763,944 | A | 9/1956 | Magee |
| 3,391,478 | A | 7/1968 | Astill |
| 3,413,738 | A | 12/1968 | Goldberg |
| 3,465,456 | A | 9/1969 | Mever |
| 3,604,517 | A | 9/1971 | Clifford |
| 3,665,622 | A | 5/1972 | Lamb |
| 3,793,752 | A | 2/1974 | Synder |
| 4,249,323 | A | 2/1981 | Mathis |
| 4,275,514 | A | 6/1981 | Maura |
| 4,306,362 | A | 12/1981 | Waterman |
| 4,356,645 | A | 11/1982 | Hine |
| 4,446,639 | A | 5/1984 | Bohn |
| 4,570,366 | A | 2/1986 | Yost |
| 4,597,205 | A | 7/1986 | Guest |
| 4,707,936 | A | 11/1987 | Steinhoff |
| 4,723,609 | A | 2/1988 | Curtis |
| 4,741,116 | A | 5/1988 | Engle |
| 4,819,349 | A | 4/1989 | Mensch |
| 4,936,392 | A | 6/1990 | Kitchin |
| 4,962,600 | A | 10/1990 | Zellaha |
| 5,014,451 | A | 5/1991 | Bandzul |
| 5,046,271 | A | 9/1991 | Daniels |
| 5,121,562 | A | 6/1992 | Feller |
| 5,129,169 | A | 7/1992 | Aubichon |
| 5,136,795 | A | 8/1992 | Rosenberg |
| 5,285,588 | A | 2/1994 | Niemela |
| 5,297,351 | A | 3/1994 | Cote |
| 5,392,538 | A | 2/1995 | Geerligs |
| 5,411,102 | A | 5/1995 | Nickels |
| 5,471,770 | A | 12/1995 | Ferreira |
| 5,568,694 | A | 10/1996 | Capra |
| 5,599,135 | A | 2/1997 | Delaurenti |
| 5,611,157 | A | 3/1997 | Ferreira |
| 5,638,618 | A | 6/1997 | Niemela |
| 5,697,731 | A | 12/1997 | Bonds |
| 5,724,755 | A | 3/1998 | Weagley |
| 5,860,230 | A | 1/1999 | Daniels |
| 5,894,689 | A | 4/1999 | Turk |
| 5,899,007 | A | 5/1999 | Niemela |
| 6,112,438 | A | 9/2000 | Weagley |

FOREIGN PATENT DOCUMENTS

| | | |
|---|---|---|
| WO | WO 98/19016 | 5/1998 |

*Primary Examiner*—Robert E. Pezzuto
(74) *Attorney, Agent, or Firm*—Greenwald & Basch LLP; Duane C. Basch

(57) ABSTRACT

The present invention is directed to a pusher apparatus for moving materials on a ground surface and a method for manufacturing such pushers using a bifurcated process that enables customization of the pusher for use with a plurality of agricultural tractor configurations. The bifurcated process includes prefabrication of a blade assembly with at least a blade, channel supports and vertical side walls, followed by a subsequent process for completing the apparatus by mounting one of at least two alternative attachment mechanisms to the rear of the blade assembly.

13 Claims, 4 Drawing Sheets

COMPACT MATERIAL PUSHER WITH UNIVERSAL DESIGN AND METHOD OF MANUFACTURE

This invention relates generally to an improved material pusher for use with agricultural equipment, and more particularly to a design and method of manufacture of a compact material pusher in order to improve the manufacturability of the material pusher.

BACKGROUND AND SUMMARY OF THE INVENTION

The present invention is an improved snow or material pusher for use with agricultural and larger home and garden tractors on generally flat areas such as driveways, feed lots, and loading and parking areas.

A "pusher" differs from a typical snow plow blade or bucket as might generally be found on such implements. Pushers, as described, for example in U.S. Pat. No. 5,724,755 to Weagley (issued Mar. 3, 1998) or the folding Material Plow of U.S. Pat. No. 6,112,438, to Weagley et al. (issued Sep. 9, 2000), both assigned to Pro-Tech Welding and Fabrication, Inc. and hereby incorporated by reference in their entirety, include sides extending forward from the mold board to assure material being pushed (e.g., material, water, debris, sludge, etc.) remains in front of the pusher, and is not directed to the side as with conventional plows. Whereas the larger material pushers were designed for use with loaders and other heavy-duty equipment for clearing parking lots, runways and roads, there is a need for a smaller, lighter-weight version that may be used by agricultural and lawn/garden tractors having front or rear lifting capability (e.g., buckets)—not only for snow removal, but for clearing of debris, including animal waste, etc.

Heretofore, a number of patents and publications have disclosed plow configurations, the relevant portions of which may be briefly summarized as follows:

U.S. Pat. No. 5,724,755 to Weagley, issued Mar. 3, 1998, discloses a snow pusher having a transverse blade, side plates, wear shoes and horizontal posts for attaching the pusher to a bucket loader.

U.S. Pat. No. 6,112,438, to Weagley et al., issued Sep. 9, 2000, is directed to a foldable version of the snow pusher.

In accordance with the present invention, there is provided a material pusher including: an upstanding transverse blade with a front surface and a rear surface, said rear surface of said blade being stiffened using at least two longitudinal channels extending substantially the length of said blade and in parallel with one another, wherein one of said longitudinal channels is attached to the rear surface of said blade in a position so as to make an outer surface of the channel substantially perpendicular with the ground surface upon which the material pusher will travel and where the one channel further provides at least one surface for mounting of an attachment mechanism; a reversible rubber edge removably fastened to a lower edge of said blade at a position adjacent the ground surface; vertical side plates extending forward from each of a pair of opposing ends of said blade; and a wear shoe removably mounted on each of said side plates for sliding contact with the ground surface.

In accordance with another aspect of the present invention, there is provided a method of manufacturing a material pusher, comprising the steps of: bending metal plate into an arc to produce an upstanding transverse blade with a front surface and a rear surface; welding, to said rear surface of said blade, at least a top and a main longitudinal channel extending substantially the length of said blade and in parallel with one another to stiffen said blade, wherein said main longitudinal channel is attached to the rear surface of said blade in a position so as to make an outer surface of said main channel substantially perpendicular with the ground surface upon which the material pusher will travel and where said main channel further provides at least one surface for mounting of an attachment mechanism; attaching, to each of a pair of opposing ends of said blade, vertical side plates extending forward from the blade; attaching a reversible rubber edge to a lower edge of said blade at a position adjacent the ground surface; and removably mounting wear shoes on each of said side plates for sliding contact with the ground surface.

One aspect of the invention is based on the discovery that a pusher suitable for use with a broad range of agricultural tractors and other equipment may be partially mass-produced and then completed, with appropriate attachment mechanisms, in response to customer orders or inventory requirements. Furthermore, the design of such units results in a reduction in weight required to make the pushers usable with smaller tractors such as those found in agricultural and home/garden situations. This discovery of a design employing a main longitudinal channel that serves for stiffening the pusher blade and as a mounting attachment bearing surface avoids problems that arise in providing a variety of mounting attachments.

The techniques described above are advantageous because they provide a simple means of enabling the efficient production of compact pushers with a variety of attachment requirements, as compared to other approaches that require a custom design for each attachment mechanism. The techniques make it unnecessary to have a large inventory of pushers for each type of tractor that could use the pusher. Furthermore, the technique can be adapted to any of a number of plow or implement designs. As a result of the invention, it is possible to pre-fabricate components of the final pusher product and to simply tailor the attachment mechanism to the customer requirements, and mount the attachment mechanism to the blade assembly prior to shipping to the customer.

Figure 1:
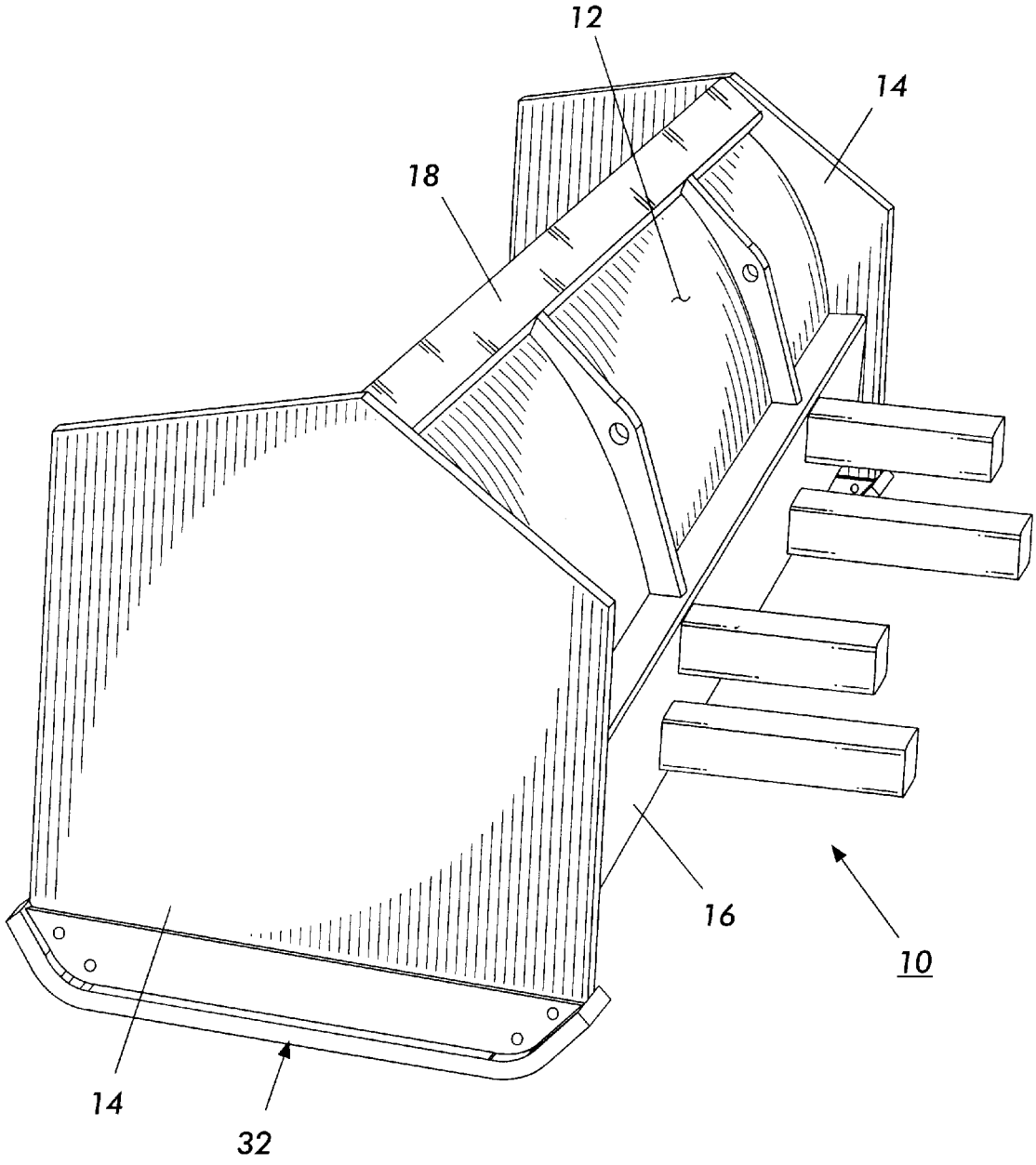
FIG. 1 is a perspective illustration of an embodiment of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements. In describing the present invention, the following term(s) have been used in the description. A "ground surface" refers to any surface such as a roadway, driveway, parking lot, runway, feed lot or the like where a pusher is to be used. Such ground surfaces are generally flat areas that do not have significant bumps or barriers extending upward and above the surrounding region. Similarly, "rubber" is intended as a convenient term to include the entire range of rubbers or elastomeric materials, particularly those suitable for the use as a flexible yet resilient edge as described herein.

Referring now to the figures, the pusher 10 includes an upstanding steel blade 12 constructed of 0.125 inch thick steel plate, and a vertical side plate 14 made of 0.125 inch steel plate at each end of the blade 10 and extending generally in a forward direction from the blade. The rear or back side of the blade 10 includes at least two horizontal reinforcing channels 16 and 18 welded across the longitudinal width of the blade 12. Longitudinal channels 16 and 18 are both U or C-shaped rectangular channel, where the upper channel 18 has a channel width of approximately 3 inches, height of approximately 1.41 inches and a wall thickness of approximately 0.170 inches and the lower or main channel has a channel width of approximately 8 inches, height of approximately 2.26 inches and a wall thickness of approximately 0.220 inches. The reinforcing channel members 16 and 18 are welded along their entire lengths to the blade 12. Welded straight channels are believed to be inherently stronger and not prone to failure by buckling, as compared to vertical curved ribs cut from steel plate.

Figure 2:
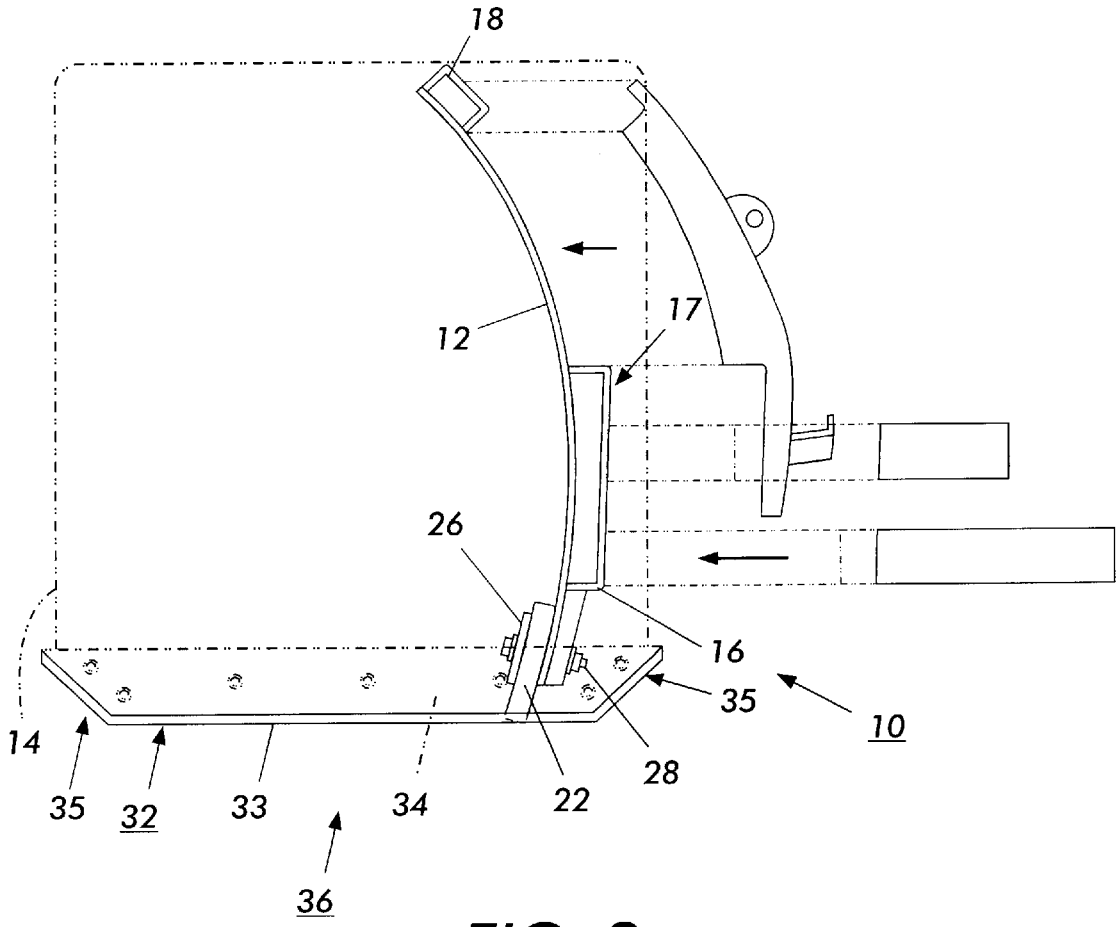
FIG. 2 is a side orthogonal view of the present invention with alternative embodiments depicted.

Furthermore, as depicted in FIG. 2, the rear surface of main channel 16, surface 17, is positioned so that it is generally perpendicular to the ground surface on which the blade will ride. Placement of the main channel in such a position allows the channel to be used as the structural component to which any of a number of mounting attachments may be attached.

Pusher 10 may also include a backing flat stock member (not shown) behind the bottom edge of the blade 12, where the backing member would also extend the width of the blade to provide support to the lower blade edge. The backing member may also be stiffened by gussets (not shown) spaced along the width of the blade. Referring also to FIG. 2, there is shown a side view of the pusher. In FIG. 2, a resilient rubber edge 22 is mounted along the bottom of the blade 12, extending approximately two inches below the bottom edge of the blade. The rubber edge 22 is at least 1.0 inch thick and approximately 6.0 inches in height. Rubber edge 22 is made from a rubber or similar elastomeric material, preferably having a durometer of approximately 6.8, and includes bolt holes for removably mounting to edge the blade 12 using a face plate 26 and threaded bolts and nuts 28. Mounting of the rubber edge 16 is adjustable and reversible to accommodate for wear.

The vertical side plate 14 extends in a generally forward direction from each end of the blade 12. Each side plate includes a removable wear shoe 32 on its bottom for sliding contact with the ground surface. The wear shoes 32 each include a bottom runner 33 and a vertical web 34. The runners 33 are made of A514;T-1 high carbon alloy steel, approximately 0.75 inches thick and 3.0 inches wide, with 45-degree. ramp surfaces 35 at the front and back to permit easy riding over surface irregularities and the like. The wear shoe 32, by means of bolt through-holes in their vertical webs 34, are removably fastened to their respective vertical side plates 14 by bolts (not shown). When the wear shoes 32 are affixed to the side plates, there is a clearance of about two inches between the ground surface and the blade bottom. The rubber edge 22 extends to the ground surface and acts as a "squeegee" over the ground surface, but does not bear the weight of the pusher. Rubber edge 22 is preferably flexible enough to glide over ground surface irregularities without gouging asphalt, concrete, or tar-gravel surfaces. It also rides easily over grates, manhole covers, and other such potential hazards, permitting higher speed and damage-free material removal.

Referring next to FIG. 2 in conjunction with FIGS. 3, 4 and 6, the method of manufacturing a compact pusher in accordance with the present invention will be described in detail. In particular, the blade assembly is initiated at step 100 by bending the blade stock into an arc-shaped blade. Subsequently, at step 102, the main horizontal channel is welded to the blade along its length so as to provide a rigidized blade. In one embodiment, a 0.025 inch thick flat plate may also be welded along the bottom of the steel blade to provide a reinforced mounting support for the rubber edge. Next, at step 104, the top horizontal channel is welded to the blade, again along its entire length to stiffen the upper portion of the blade. At step 106, the side plates are fabricated and attached to the main blade assembly by welding. Having completed steps 100–106, the blade is in a semi-completed condition, where the blade assembly 36 (including at least blade, side plates and longitudinal channels) may then be stored in inventory. It is also possible, as reflected in steps 110 and 112 respectively, to attach the removable wear shoes to the bottoms of the side plates and to provide and mount the rubber edge to the blade bottom at this point if the assembly has been primed or painted (not shown).

Figure 6:
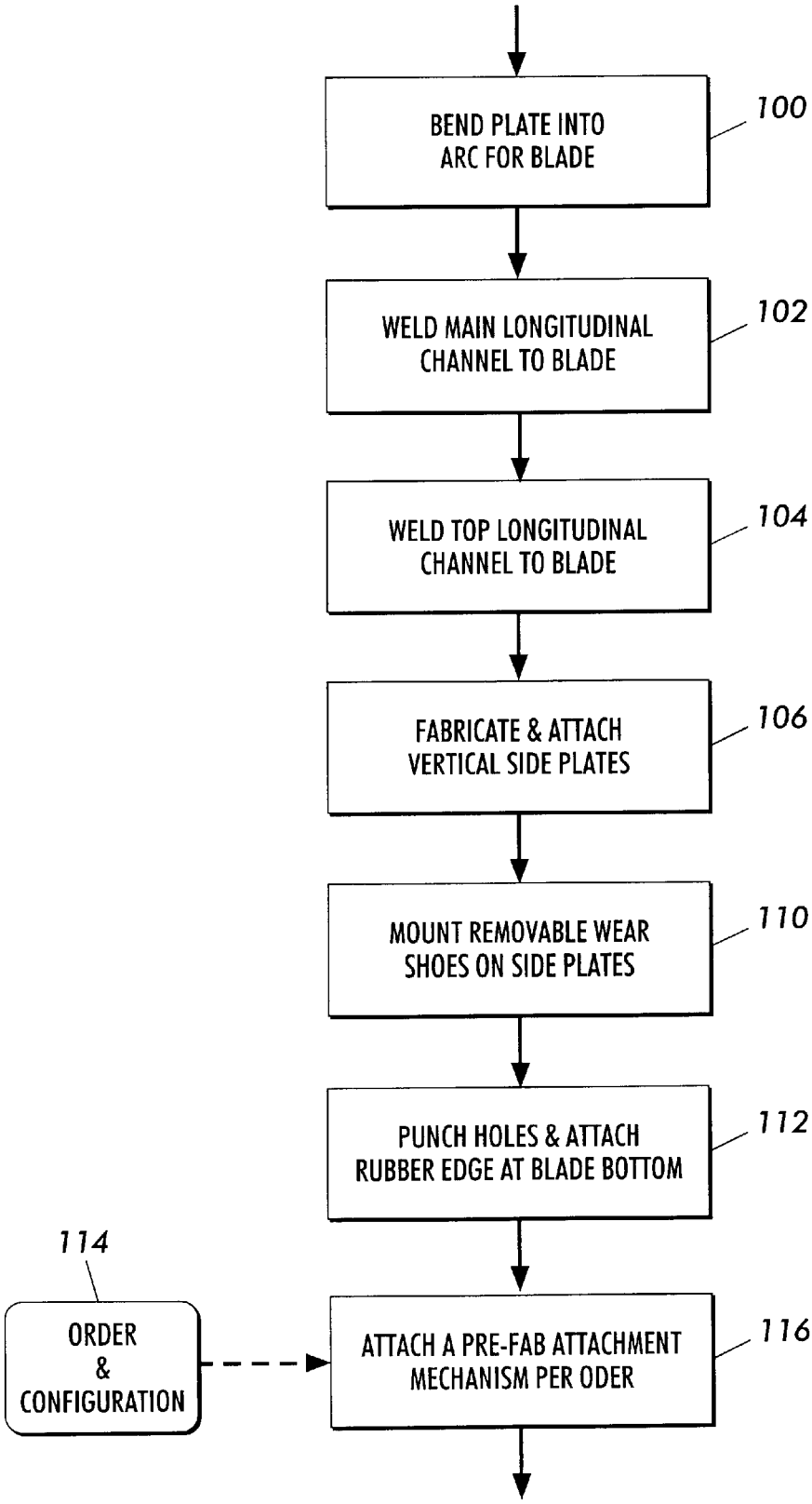
FIG. 6 is flow chart illustrating the various steps of a bifurcated manufacturing process in accordance with an aspect of the present invention.

As depicted through step 112 of FIG. 6, and in FIG. 2, the blade assembly is complete, except that the particular mounting assembly to be used for the pusher is not yet installed. As further represented in FIGS. 3 and 4, and by step 116 of FIG. 6, assembly of the pusher may be completed after receipt of a customer order (step 114), where the appropriate attachment mechanism is determined based upon the customer requirements and the unit is then completed by mounting the attachment mechanism 38 to the rear of the blade assembly 36 and shipped (to a customer or a distributor).

Figure 3:
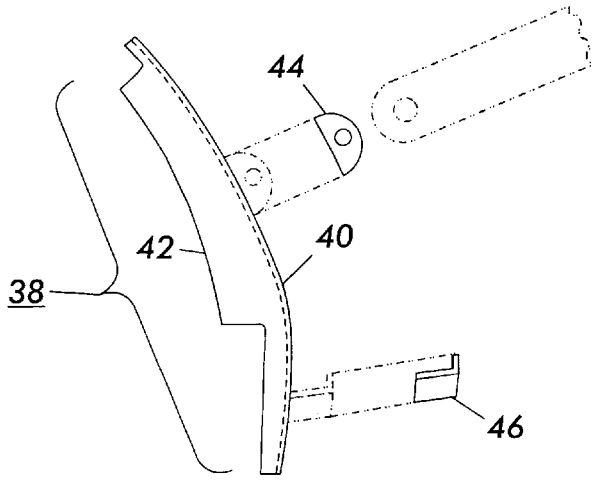
FIGS. 3 and 4 are assembly views of components for the alternative attachment mechanism that form part of the present invention.

Referring specifically to FIG. 3, a "universal" flat plate mounting system is employed to allow for easy customization and pre-fabrication of an original equipment manufacturer (OEM) coupler that will adapt to numerous tractors having bucket attachments. The universal mount 38 depicted in FIG. 3 includes a flat plate 40 of 0.3125 inch thick steel having a width of at least approximately 24 inches and a height of approximately 18 inches. The plate has at least one gusset 42 welded or attached to an edge or back side thereof. Gusset 42 is preferably designed so as to fit within the region between longitudinal channels 16 and 18, linking the two channels and providing support for the rear surface of the blade. It will be appreciated that plate 40 and gusset(s) 42 may be prefabricated and assembled.

Figure 5:
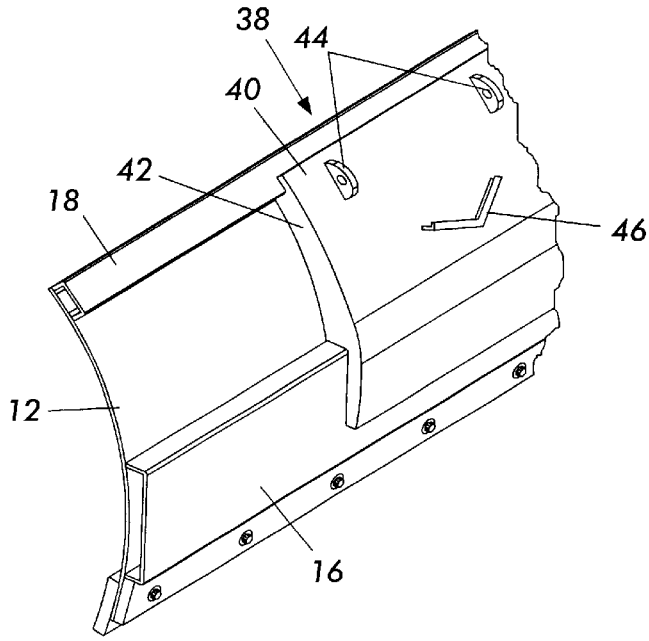
FIG. 5 is a perspective illustration of an alternative embodiment of the present invention.

Subsequently, once the configuration of a customer's tractor is known, mounting bosses 44, of a pivot/pin type and a hook or similar protrusion 46, may be welded or otherwise attached to plate 40 at the proper locations for use with a particular tractor make/model. When the attachment mechanism 38 is completed, it may then be assembled or mounted to the blade assembly by welding or otherwise affixing the mechanism to the blade assembly. It will be appreciated that welding may be a preferred process for completing the fabrication of the assembly, however, various alternative assembly methods exist, including rivets and high-strength bolts that may prove suitable for smaller size blade assemblies. Referring briefly to FIG. 5, there is shown an exemplary illustration of the assembly of a universal attachment mechanism 38, as depicted in FIG. 3, to the rear of a blade assembly 10.

Figure 4:
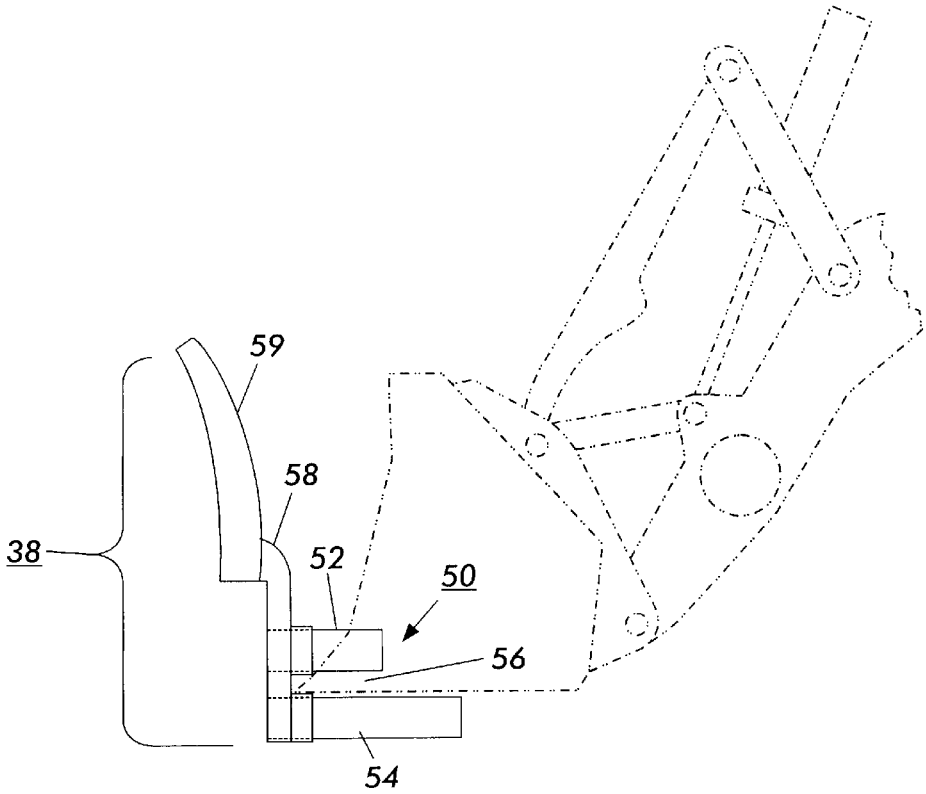

Referring next to FIG. 4, depicted therein are the components of an alternative attachment mechanism 38, including a pair of horizontal posts 50. In a preferred embodiment attachment mechanism 38 would include at least two pairs of such posts, providing an upper horizontal row of posts 52, and a lower horizontal row of posts 54, extending out from the main longitudinal channel 16 on the back of the blade assembly. The parallel upper and lower rows of posts form a horizontal receptacle or slot 56 therebetween for receiving a bucket (not shown) of a tractor. The bucket is movable into and out of the slot 56 to, respectively, engage the pusher 10 for operation, and to disengage the pusher.

The horizontal posts 52 and 54 are rectangular in cross-section (e.g., 3×3 inches) as depicted in FIG. 1, but may also be formed in the nature of arms or other rearwardly extending features defining a horizontal slot therebetween. Such an attachment mechanism is well-known for use on snow pushers. In general, the upper posts 52 are of slightly shorter in length than the lower posts 54 so as to facilitate the placement and engagement of the lower lip of a tractor bucket. As illustrated in FIGS. 1 and 2, the orientation of channel 16, so that its rear-facing surface 17 is oriented vertically, allows for the bucket attachment mechanism to be directly welded thereto without special cutting of the ends of tubes 52 and 54.

As further depicted in FIG. 4, the attachment mechanism 38 includes at least one reinforcing gusset 59 spanning between the main and top longitudinal channels. It will be appreciated that while these individual items may be fabricated as individual components that subsequently attached to the blade assembly, they may also be fabricated as an assembly by the addition of a temporary coupling or fixturing jig 58 that will allow for ease of assembly when a blade assembly is to be fabricated with a bucket-type attachment mechanism as depicted in FIGS. 1 and 4.

In recapitulation, the present invention is directed to a pusher apparatus for moving materials and a method for manufacturing such pushers on a large scale using a bifurcated manufacturing design and process that allows for easy customization of the pushers for use with a plurality of agricultural tractor configurations. The bifurcated process includes pre-fabrication of a blade assembly with at least a blade, channel supports and vertical side walls, and a subsequent process for completing the assembly by mounting one of at least two alternative attachment mechanisms to the rear of the blade assembly.

It is, therefore, apparent that there has been provided, in accordance with the present invention, an apparatus and efficient method of manufacturing a compact pusher for use with agricultural tractors. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A material pusher including:

an upstanding transverse blade with a front surface and a rear surface, said rear surface of said blade being stiffened using at least two longitudinal channels extending substantially the length of said blade and in parallel with one another, wherein a first of said longitudinal channels is attached to the rear surface of said blade in a position so as to make an outer, rear-facing surface of the first channel perpendicular with the ground surface upon which the material pusher will travel and where the first channel further provides said outer surface for mounting of an attachment mechanism thereto;

a rubber edge removably fastened to a lower edge of said blade at a position adjacent the ground surface;

vertical side plates extending forward from each of a pair of opposing ends of said blade; and a wear shoe mounted on each of said side plates for sliding contact with the ground surface.

2. The apparatus of claim 1, wherein the attachment mechanism includes:

at least two pairs of arms, said pairs of arms attached to and extending rearward from the outer, rear-facing surface of the first channel in a direction perpendicular thereto, each of the pairs of arms defining an open, generally horizontal slot for removable insertion therein of an equipment bucket for moving the material pusher.

3. The apparatus of claim 2, wherein each of said pairs of arms are pre-assembled and held in a spaced-apart relationship by a vertical gusset that further extends between the longitudinal channels.

4. The apparatus of claim 3, wherein an outermost pair of said at least two pairs of arms are positioned with a distance between them sufficient to allow the upper arms of the outermost pair to fit within the sides of a bucket located on an agricultural tractor.

5. The apparatus of claim 3, wherein each of said pairs of arms are comprised of a pair of rectangular steel tubes, wherein upon final assembly, said steel tubes are welded to the outer surface of the first channel and define a horizontal slot therebetween.

6. The apparatus of claim 1, wherein the attachment mechanism includes a universal plate assembly attached to and spanning a vertical space between said longitudinal channels, where the plate assembly spans a vertical distance sufficient to accommodate an equipment attachment mechanism.

7. The apparatus of claim 6, wherein the universal plate assembly attached to and spanning a space between said longitudinal channels includes at least one boss for connecting the assembly to a tractor bucket mount.

8. The apparatus of claim 6, wherein said universal plate assembly includes a vertical reinforcement gusset on either end thereof to provide support and to stiffen the blade.

9. The apparatus of claim 1, wherein the wear shoe includes inclined front and rear ramp surfaces.

10. A method of manufacturing a material pusher, comprising the steps of:

bending metal plate into an arc to produce an upstanding transverse blade with a front surface and a rear surface;

welding, to said rear surface of said blade, at least a top and a main longitudinal channel extending substantially the length of said blade and in parallel with one another to stiffen said blade, wherein said main longitudinal channel is attached to the rear surface of said blade in a position so as to make an outer surface of said main channel substantially perpendicular with the ground surface upon which the material pusher will travel and where said main channel further provides at least one surface for mounting of an attachment mechanism;

attaching, to each of a pair of opposing ends of said blade, vertical side plates extending forward from said blade;

attaching a reversible rubber edge to a lower edge of said blade at a position adjacent the ground surface;

removably mounting wear shoes on each of said side plates for sliding contact with the ground surface; and attaching one of a plurality of prefabricated attachment mechanisms to the rear of said material pusher, wherein the attachment mechanism is attached to at least one of the longitudinal channels.

11. The method of claim 10, further including, the steps of:

fabricating the attachment mechanism, wherein the attachment mechanism includes a plate having bosses welded on one side thereof for direct coupling, with pins, to a tractor mount and on the opposite side thereof at least one vertical gusset spanning a gap between the longitudinal channels; and operatively attaching the attachment mechanism to the rear of said material pusher, wherein the attachment mechanism is welded to at least one of the longitudinal channels.

12. The method of claim 10, further including the step of:

receiving an order for a direct coupling attachment mechanism; and fabricating the attachment mechanism, wherein the attachment mechanism includes a plate having bosses welded on one side thereof for connection to a tractor bucket mount and on the opposite side thereof at least one vertical gusset spanning a gap between the longitudinal channels.

13. The method of claim 10, further including the steps of:

receiving an order for a bucket attachment mechanism; and assembling the components of the attachment mechanism using a fixturing jig to align the components, wherein the attachment mechanism includes at least two pairs of arms attached to and extending rearward from the outer surface of the main channel, each of the pairs of arms defining an open, generally horizontal slot for removable insertion therein of a tractor bucket.

* * * * *